US010368652B2

(12) United States Patent
Warren

(10) Patent No.: US 10,368,652 B2
(45) Date of Patent: Aug. 6, 2019

(54) APPARATUSES AND METHODS FOR CONVERTING A SEATING DEVICE INTO A SLEEPING DEVICE

(71) Applicant: Durfold Corporation, Jackson, MS (US)

(72) Inventor: Jim H Warren, Brandon, MS (US)

(73) Assignee: Durfold Corporation, Jackson, MS (US)

( * ) Notice: Subject to any disclaimer, the term of this patent is extended or adjusted under 35 U.S.C. 154(b) by 440 days.

(21) Appl. No.: 15/090,871

(22) Filed: Apr. 5, 2016

(65) Prior Publication Data

US 2016/0286968 A1 Oct. 6, 2016

Related U.S. Application Data

(60) Provisional application No. 62/143,559, filed on Apr. 6, 2015.

(51) Int. Cl.

| | |
|---|---|
| ***A47C 17/14*** | (2006.01) |
| ***A47C 17/86*** | (2006.01) |
| ***A47C 17/04*** | (2006.01) |

(52) U.S. Cl.

CPC ..... *A47C 17/14* (2013.01); *A47C 17/86* (2013.01); *A47C 17/04* (2013.01)

(58) Field of Classification Search

CPC ..... A47C 17/04; A47C 17/045; A47C 17/13; A47C 17/132; A47C 17/134; A47C 17/136; A47C 20/00; A47C 20/02; A47C 20/027; A47C 17/138; A47C 17/14; A47C 17/22; A47C 17/58; A47C 17/16; A47C 17/86; A47D 7/007

See application file for complete search history.

(56) References Cited

U.S. PATENT DOCUMENTS

| | | | | | |
|---|---|---|---|---|---|
| 288,924 | A * | 11/1883 | Cook | B65F 1/1421 | 211/83 |
| 302,469 | A * | 7/1884 | Cook | B65F 1/1421 | 211/83 |
| 591,095 | A * | 10/1897 | Evans | A47C 19/205 | 297/62 |
| 907,342 | A * | 12/1908 | Greenlund | A47C 17/86 | 5/58 |
| 2,269,607 | A * | 1/1942 | Steffen | A47C 17/16 | 5/59.1 |
| 5,020,173 | A * | 6/1991 | Dreyer, Jr. | A47C 17/86 | 297/188.1 |
| 5,901,513 | A * | 5/1999 | Mollenkopf | A47B 21/06 | 108/182 |
| 5,913,498 | A * | 6/1999 | Brown | A47B 91/024 | 248/188.2 |

(Continued)

*Primary Examiner* — Robert G Santos

(74) *Attorney, Agent, or Firm* — Jason P. Mueller; Adams and Reese LLP

(57) ABSTRACT

Embodiments of the present disclosure include methods, apparatuses, and systems for converting a seating device into a sleeping device. Embodiments include an apparatus including a convertible seating device and an adjustable storage device located beneath the convertible seating device. The convertible seating device may be converted into a sleeping device via at least one raising-lowering device pivotally connected to the seating device and storage device.

6 Claims, 10 Drawing Sheets

(56) References Cited

U.S. PATENT DOCUMENTS

| | | | | |
|---|---|---|---|---|
| 8,375,483 | B2 * | 2/2013 | Ray | A47C 7/62 5/12.1 |
| 8,656,533 | B2 * | 2/2014 | Grossman | A47B 95/002 5/280 |
| 2003/0084507 | A1 * | 5/2003 | Timoshenko | A47C 17/161 5/12.1 |
| 2007/0000047 | A1 * | 1/2007 | James | A47C 17/86 5/58 |
| 2009/0025141 | A1 * | 1/2009 | Ray | A47C 7/62 5/20 |
| 2009/0188037 | A1 * | 7/2009 | Mortimer-McKenzie | A47C 11/00 5/18.1 |
| 2009/0235462 | A1 * | 9/2009 | Grossman | A47B 95/002 5/658 |
| 2011/0010847 | A1 * | 1/2011 | Murphy | A47C 3/16 5/35 |
| 2011/0314600 | A1 * | 12/2011 | Baldassarra | A47C 17/22 5/17 |
| 2012/0246823 | A1 * | 10/2012 | Conley | A47C 17/045 5/12.1 |
| 2013/0019402 | A1 * | 1/2013 | Vervoort | A47C 21/028 5/412 |
| 2016/0286968 | A1 * | 10/2016 | Warren | A47C 17/14 |

* cited by examiner

APPARATUSES AND METHODS FOR CONVERTING A SEATING DEVICE INTO A SLEEPING DEVICE

This application claims the benefit of U.S. Provisional Patent Application No. 62/143,559, filed Apr. 6, 2015, which is incorporated herein by reference.

DESCRIPTION OF EMBODIMENTS

Several healthcare facilities utilize convertible furniture in patient rooms that may be used for seating during visiting hours and for sleeping during overnight usage. In addition to providing this furniture, these facilities also need to regularly clean the patient rooms to provide a clean and safe environment for the patient. A conflict in meeting these needs arises in the amount of time and effort a facility can dedicate to disinfecting all of the surfaces and furniture in each patient room.

Existing convertible furniture in patient rooms may be converted from a seating to a sleeping surface in several ways, including by expanding the size of the seating device, unfolding the components of the seating device within itself, or removing components of the seating device to provide a sleeping surface. Each of these current methods has several inefficiencies. The first method requires too much floor space in the patient room and incorporation of additional structural elements. The second method allows for use of only a limited amount of bedding surface and cushioning that can be folded onto itself. The third method uses inefficient and hefty drawers and/or enclosed cavities in the seating device to store components of the device.

The above methods also present additional concerns while cleaning the patient room. All exposed surface area of the furniture in the room, as well as floor space underneath the furniture, must be cleaned and disinfected in a quick timeframe before another patient may be admitted into the room. However, the structure of existing convertible furniture presents several difficulties in performing this cleaning. For example, drawers and/or cavities in a seating device may accumulate dust, grime, and/or discarded trash, and therefore require constant cleaning and additional time spent performing this cleaning.

Methods and apparatuses are provided for seating construction, and in exemplary though non-limiting embodiments, to methods and apparatuses for converting a seating device, including an adjustable storage device located beneath the seating device, into a sleeping device.

In embodiments of the present disclosure, the storage device may be adjusted to at least one of two resting positions, a fully lowered position and fully raised position, via at least one raising-lowering device pivotally connected to the seating device and storage device. Placement of the storage device in the fully lowered position allows for removal and storage of components of the seating device within the storage device to convert the seating device into a sleeping device with a sleeping surface. Placement of the storage device in the fully raised position allows for easy floor surface access for cleaning.

Figure 10:
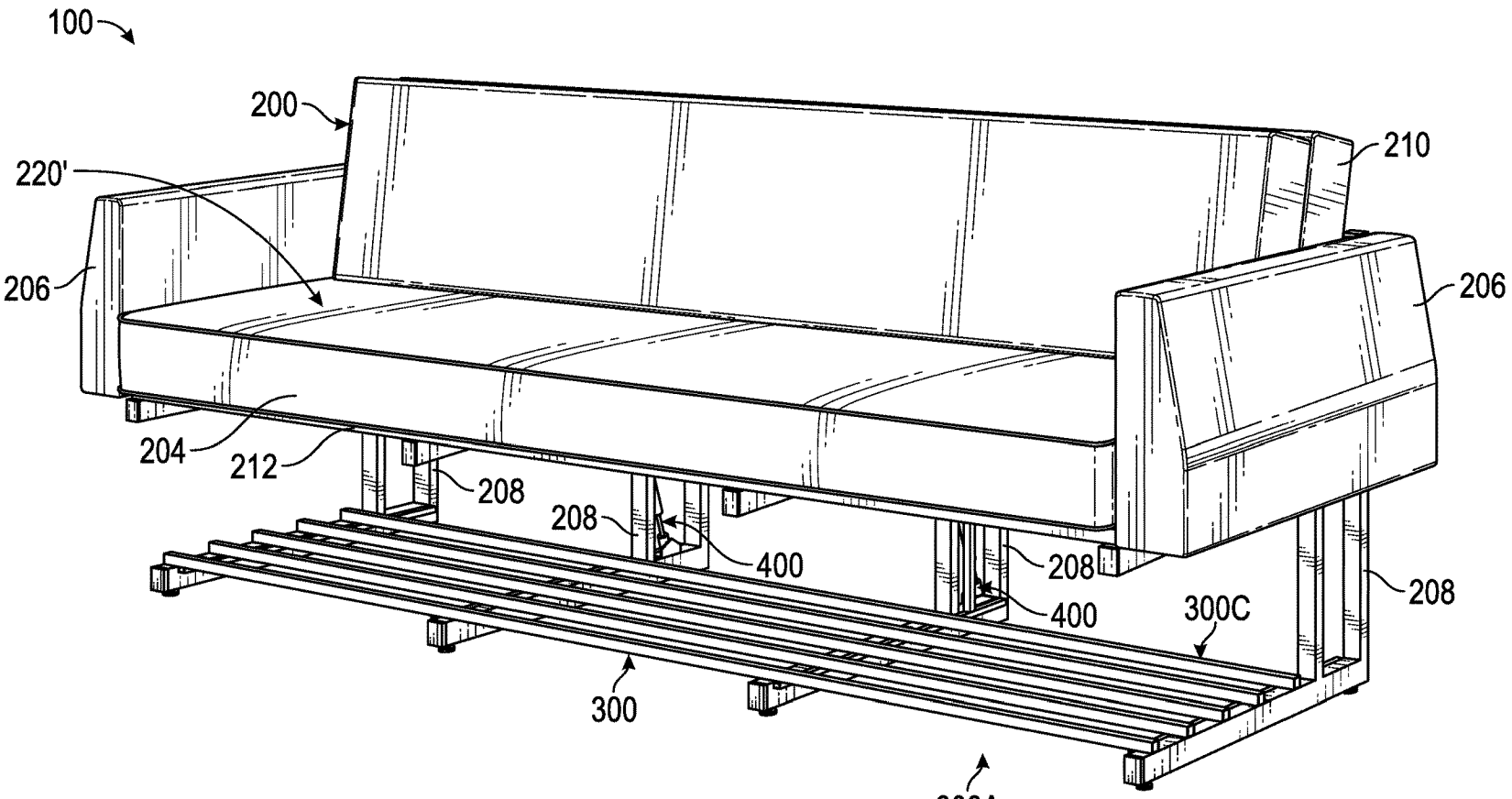
FIG. 10 is an isometric view of a seating apparatus with an adjustable storage device in a fully lowered position, according to an exemplary embodiment of the present disclosure.
Figure 11:
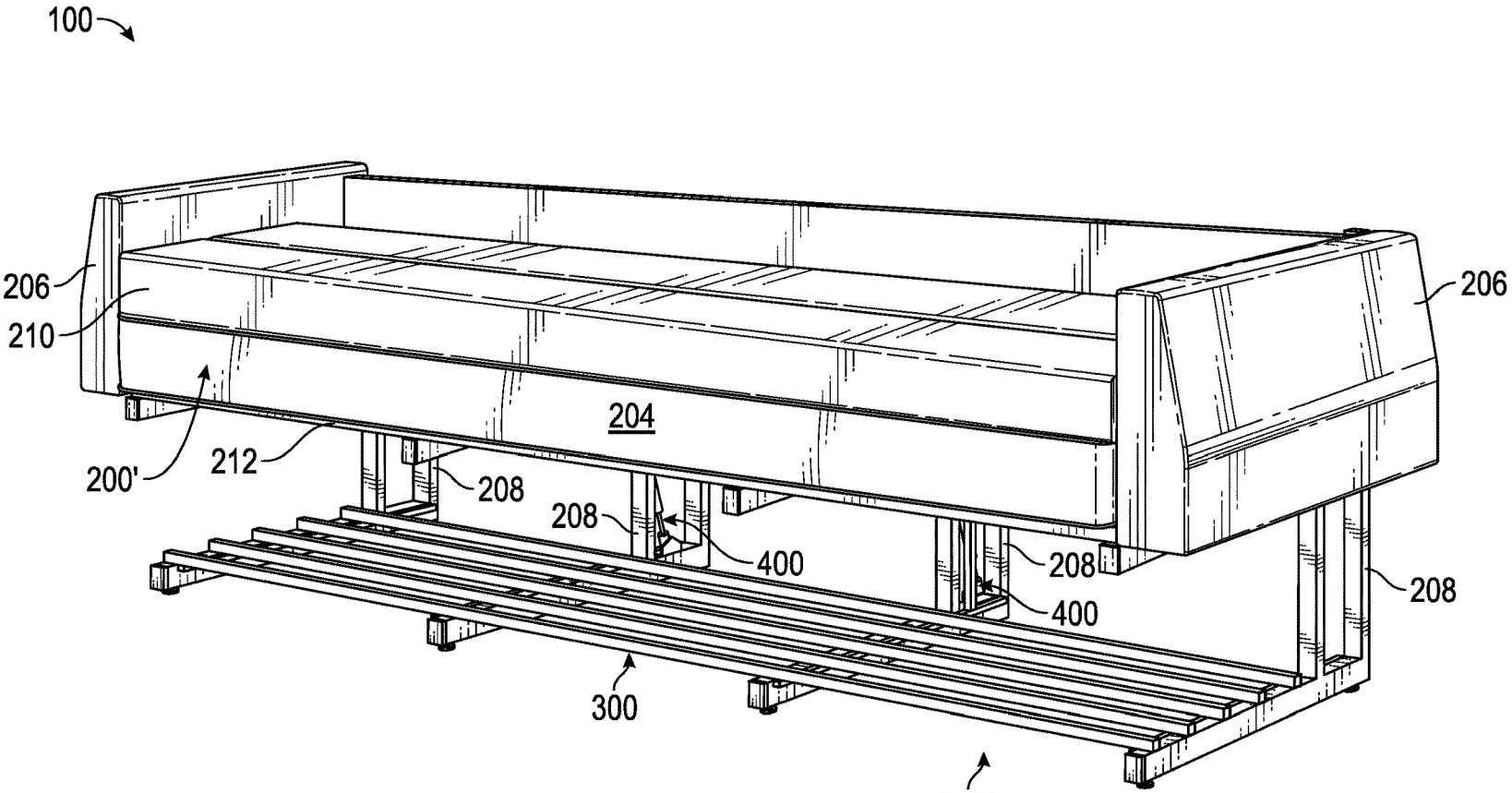
FIG. 11 is an isometric view of the seating apparatus shown in FIG. 10 with removable back cushions folded onto a base cushion of the seating apparatus, according to an exemplary embodiment of the present disclosure.
Figure 12:
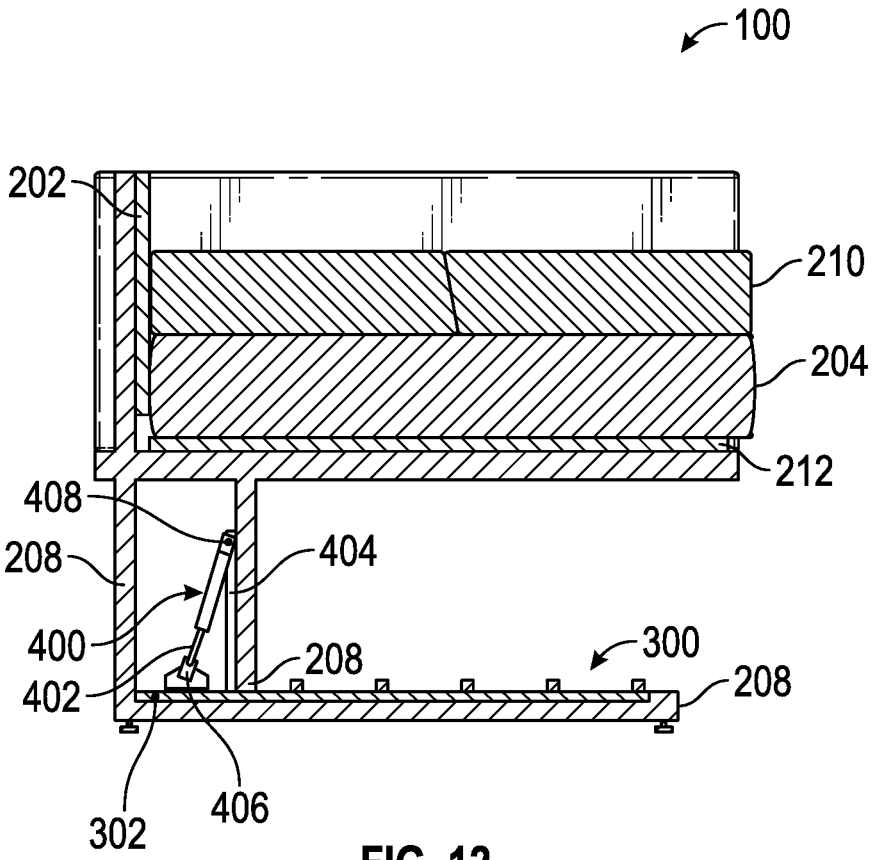
FIG. 12 is a side cross-sectional view of the seating apparatus shown in FIG. 11.

Referring to FIGS. 1 to 9, different views of a seating apparatus (100) are shown. FIGS. 10 to 12 show different views of an alternative embodiment of seating apparatus (100). Seating apparatus (100) includes a convertible seating device (200) and an adjustable/movable storage device (300) located beneath the seating device (200). Convertible seating device (200) may be converted into a sleeping device (200') via at least one raising-lowering device (400).

Seating device (200) includes a leg structure (208), a seat back (202) and seat base (212) integrated with or attached to the leg structure (208), a base cushion (204) mounted on the base (212), and at least one arm (206) mounted on the leg structure (208) at an end of the base cushion (204). See, e.g., FIGS. 1 and 7. Base cushion (204) includes a sitting surface (220). See FIG. 1. In some embodiments, base cushion (204) may be mounted directly to leg structure (208). As shown in FIGS. 1 to 12, seating device (200) includes two arms (206) mounted on leg structure (208) at opposing ends of seating device (200).

Figure 1:
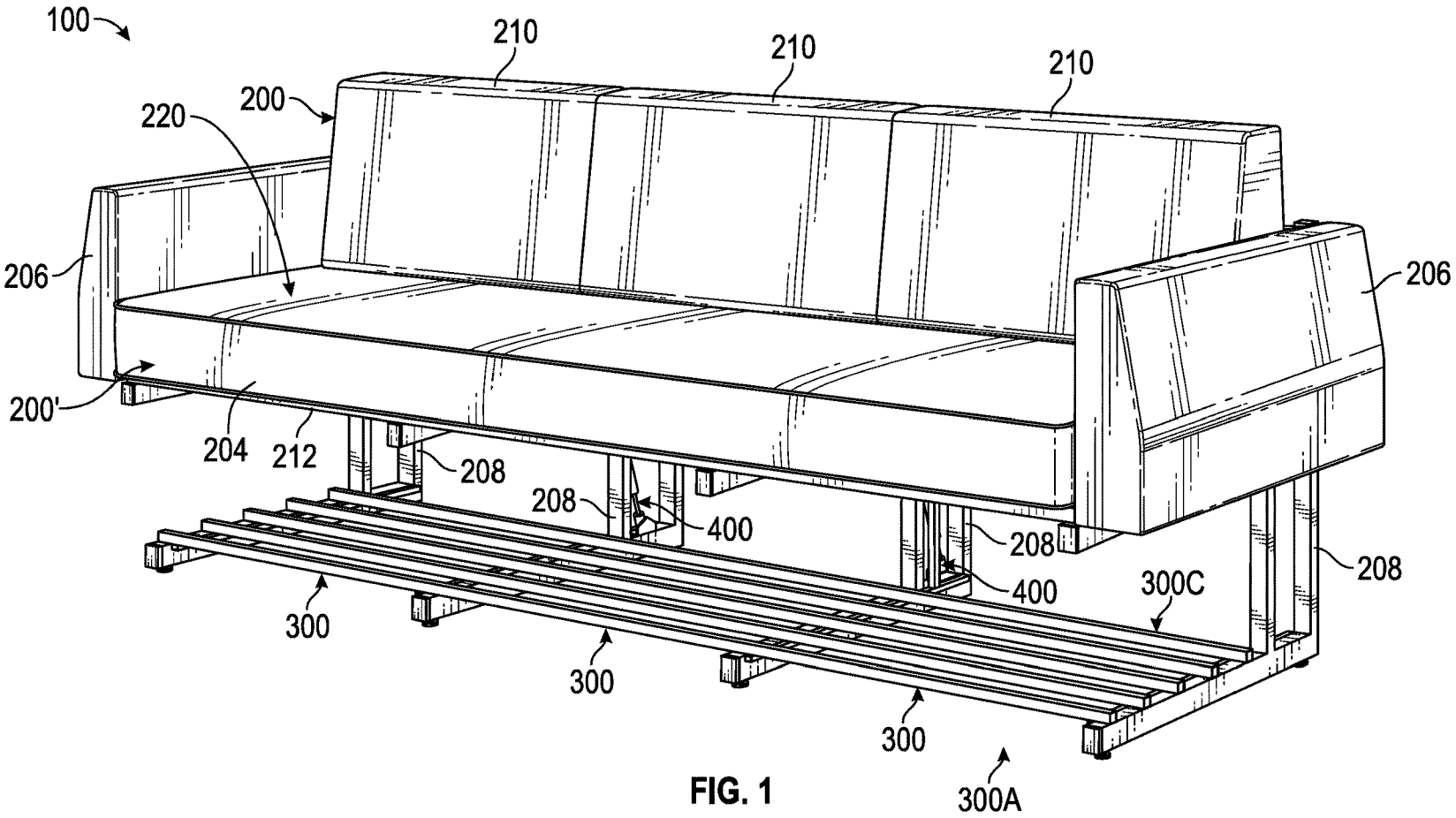
FIG. 1 is an isometric view of a seating apparatus with an adjustable storage device in a fully lowered position, according to an exemplary embodiment of the present disclosure.

Seating device (200) may further include a back support system (210). Back support system (210) may include any type of device that provides back support for a user sitting on seating device (200), including for example cushions, bolsters, and pillows. As shown in FIG. 1, back support system (210) includes at least one removable back cushion (210) placed against the seat back (202). At least one removable back cushion (210) may be appropriately sized and configured to be removed and placed within/on adjustable storage device (300) to convert seating device (200) into a sleeping device (200'). Sleeping device (200') includes the same features as seating device (200) described herein, but with the sitting surface (220) converted into a sleeping surface (220'). See FIG. 9. As shown in FIGS. 1 to 9, seating device (200) may include three removable back cushions (210) placed adjacent to each other against seat back (202). Alternatively, seating device (200) may include other configurations for back support system (210). For example, as shown in FIGS. 10 to 12, seating device (200) may include two long removable back cushions (210), with a first long removable back cushion (210) placed against the seat back (202), and a second long removable back cushion (210) placed adjacent to the first long removable back cushion (210). First and second long removable back cushions (210) may be folded down and placed adjacent to each other on base cushion (204). See, e.g., FIGS. 11 and 12.

In exemplary embodiments, leg structure (208) of seating device (200) may include four C-shaped cantilever legs (208) configured to support the seating device (200) and any user sitting on the seating device (200). Cantilever legs (208) may include beam portions made of metal or other suitable materials for supporting seating device (200). Cantilever legs (208) may include steel tubing mounted to seat base (212) or mounted directly to base cushion (204). In embodiments, each cantilever leg (208) may include at least a bottom beam portion sitting on a floor, an upper beam portion mounted to the seat base (212), and at least one upright beam connected between the bottom beam portion and the upper beam portion to support the seating device (200). See, e.g., FIG. 7. In an exemplary embodiment, each cantilever leg (208) may include two upright beams mounted adjacent to each other. See, e.g., FIG. 1. In other embodiments, upper beam portion may be mounted directly to base cushion (204).

Figure 2:
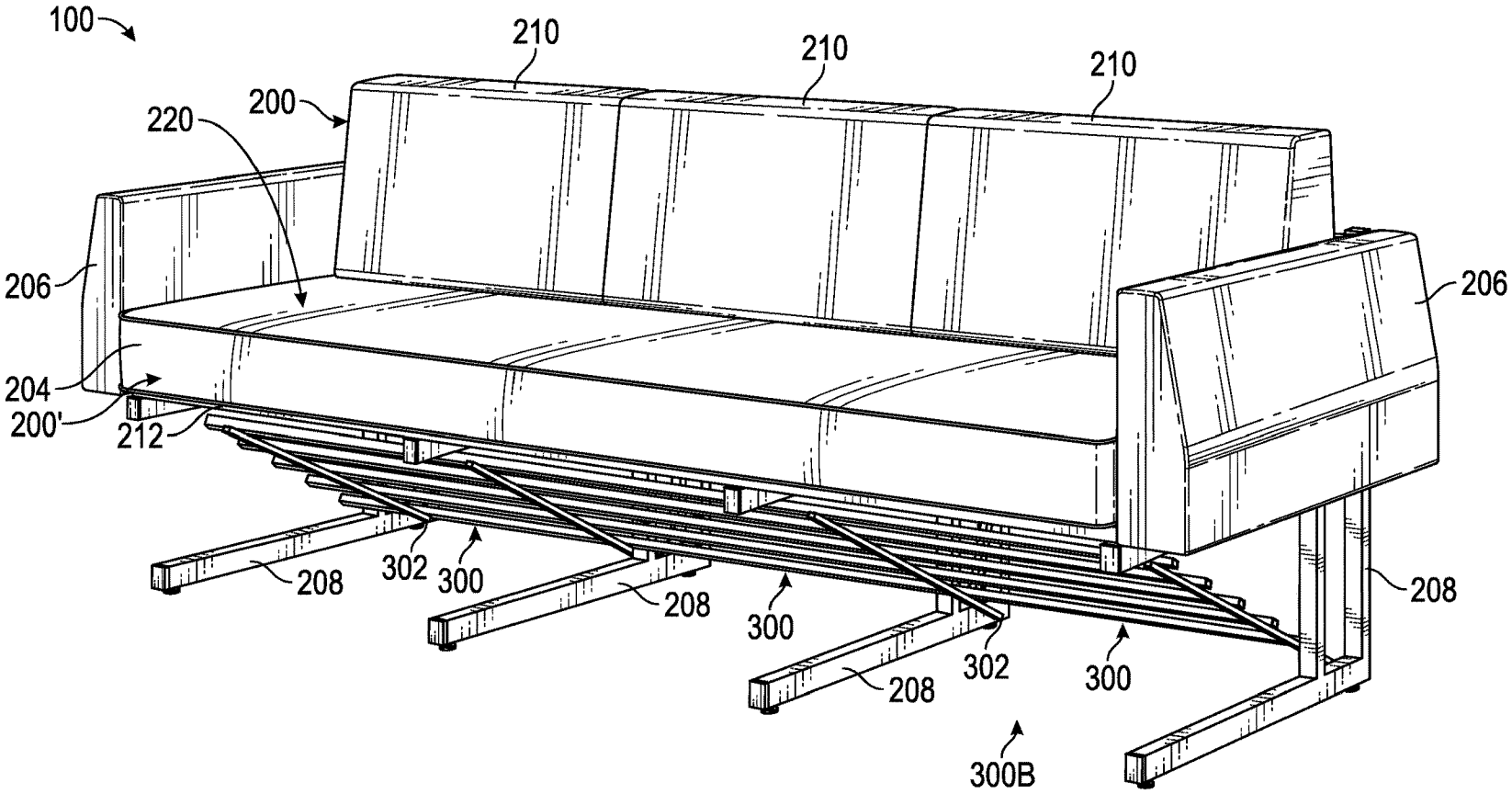
FIG. 2 is an isometric view of a seating apparatus with an adjustable storage device in a fully raised position, according to an exemplary embodiment of the present disclosure.
Figure 3:
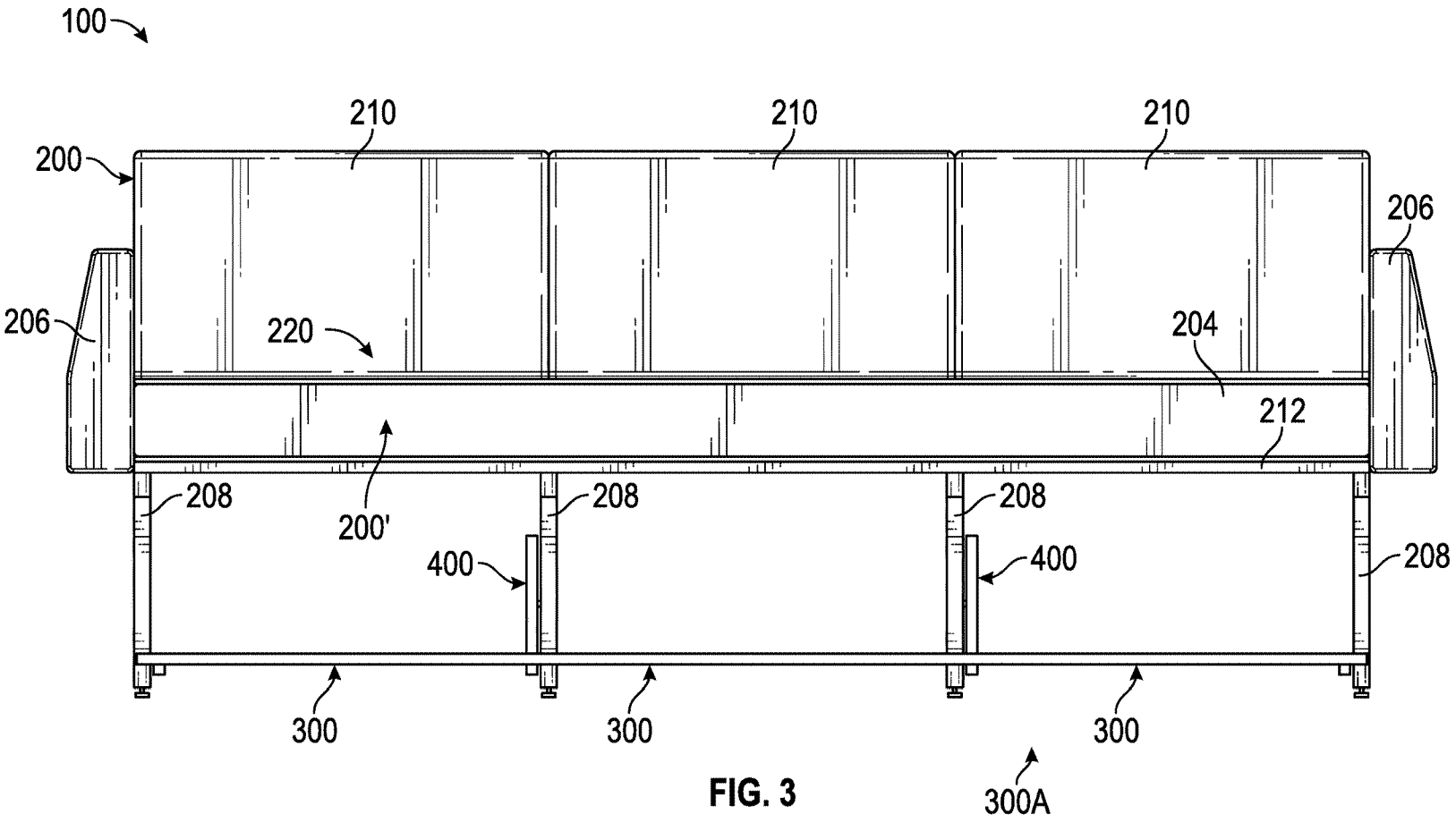
FIG. 3 is a front view of the seating apparatus shown in FIG. 1.
Figure 4:
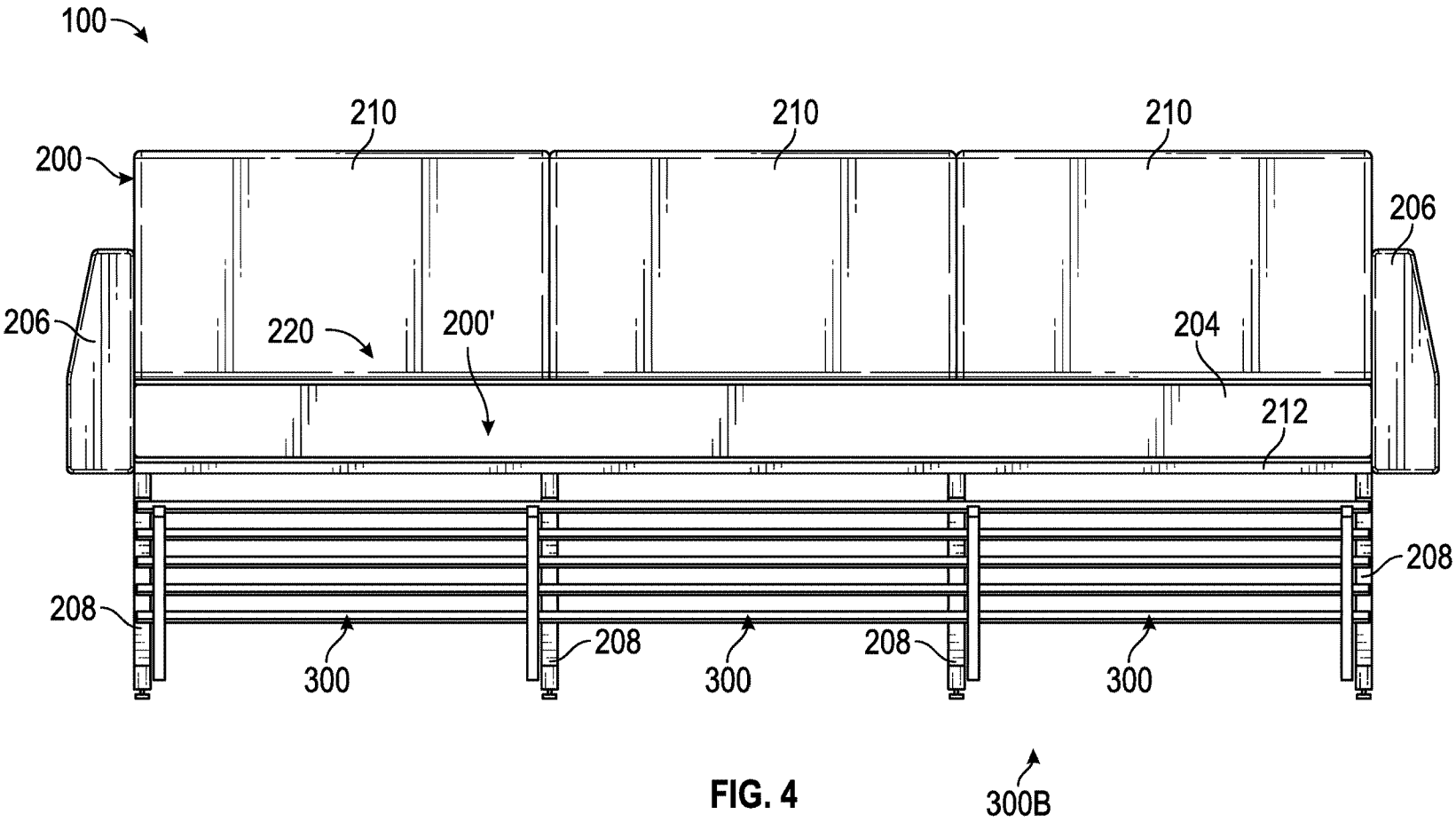
FIG. 4 is a front view of the seating apparatus shown in FIG. 2.
Figure 5:
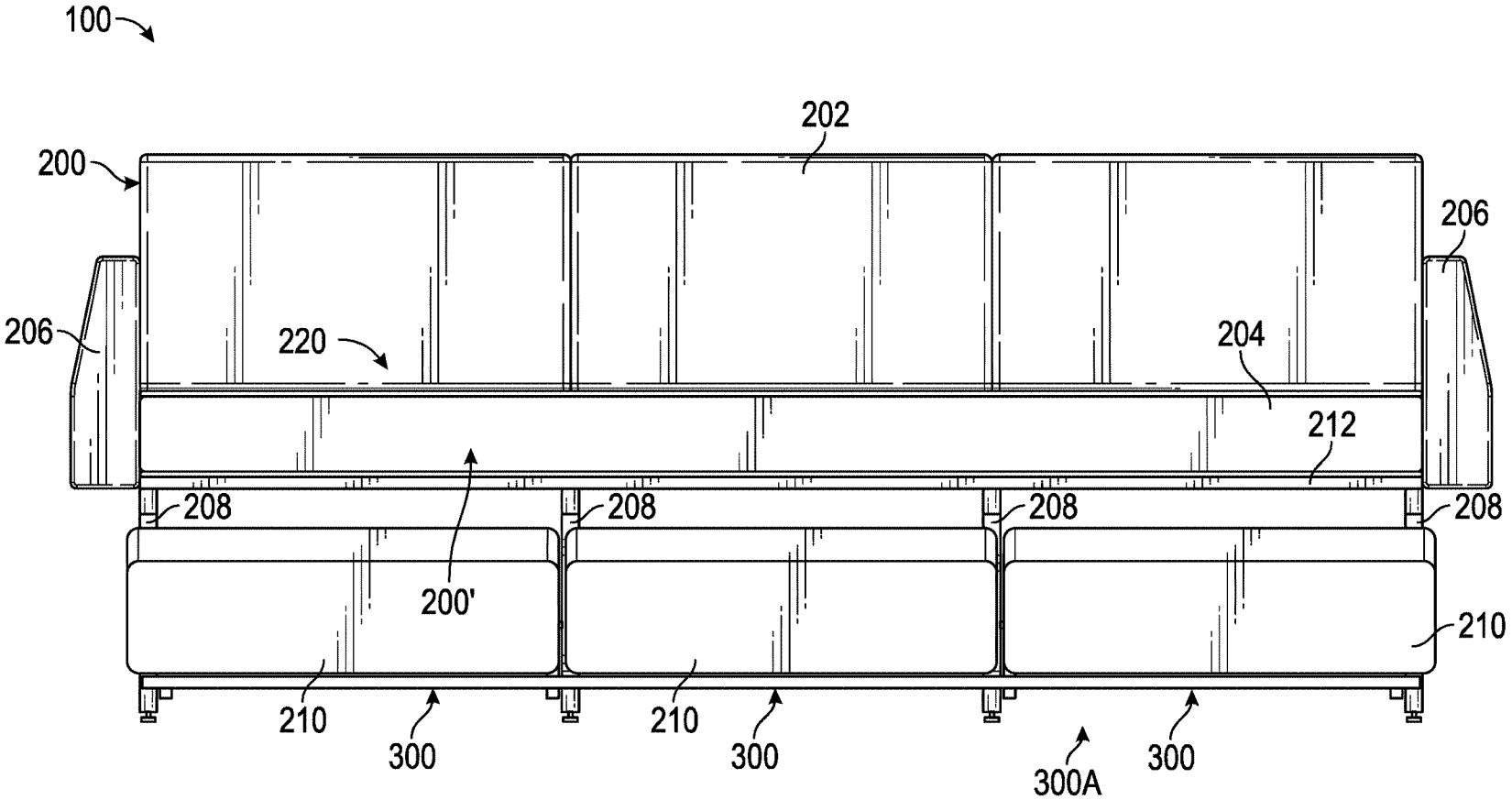
FIG. 5 is a front view of the seating apparatus shown in FIG. 1 with a back cushion placed on the storage device, according to an exemplary embodiment of the present disclosure.
Figure 7:
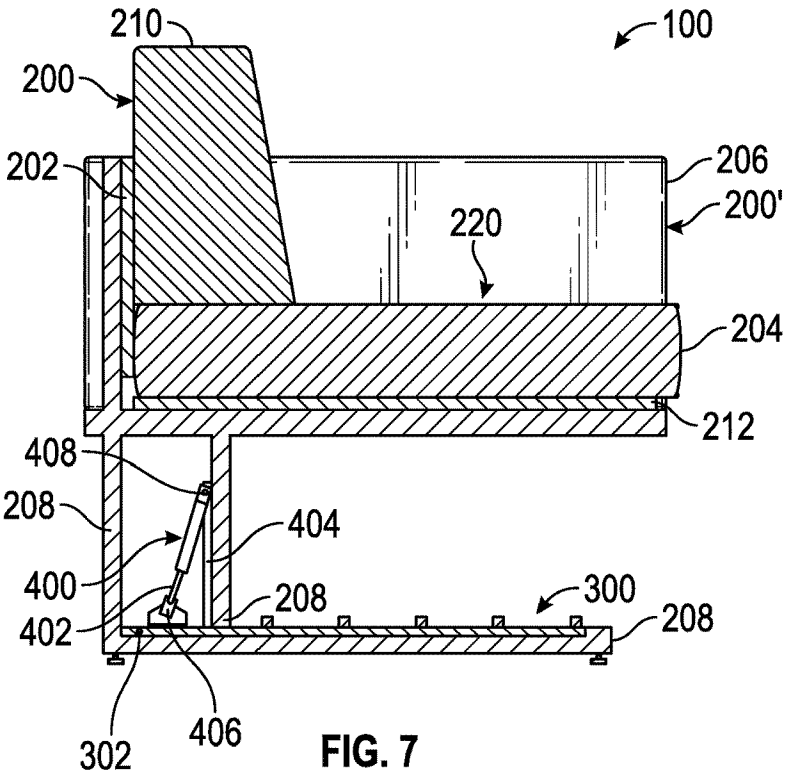
FIG. 7 is a side cross-sectional view of the seating apparatus shown in FIG. 1.
Figure 6:
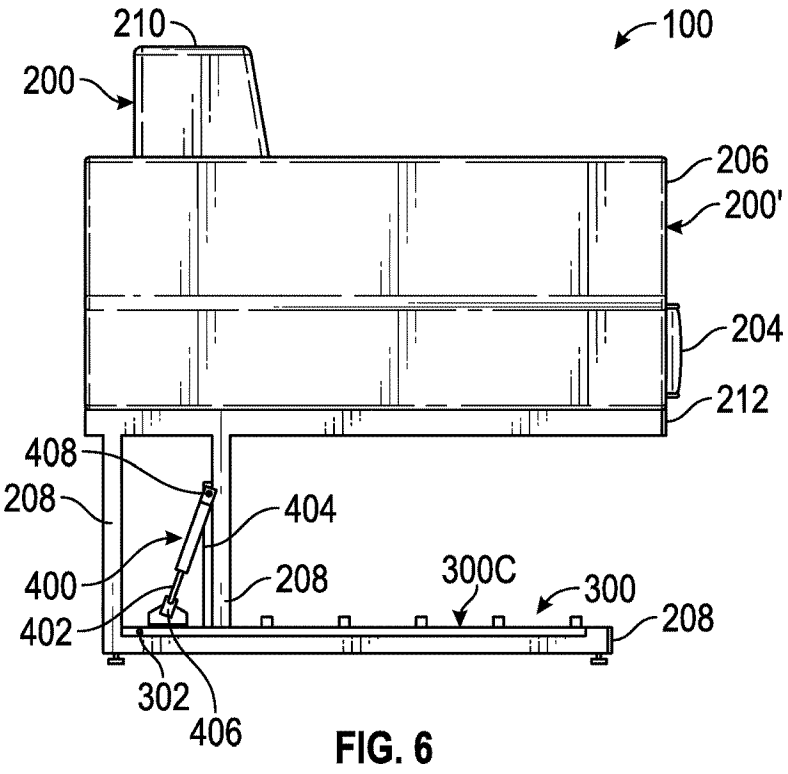
FIG. 6 is a side view of the seating apparatus shown in FIG. 1.
Figure 9:
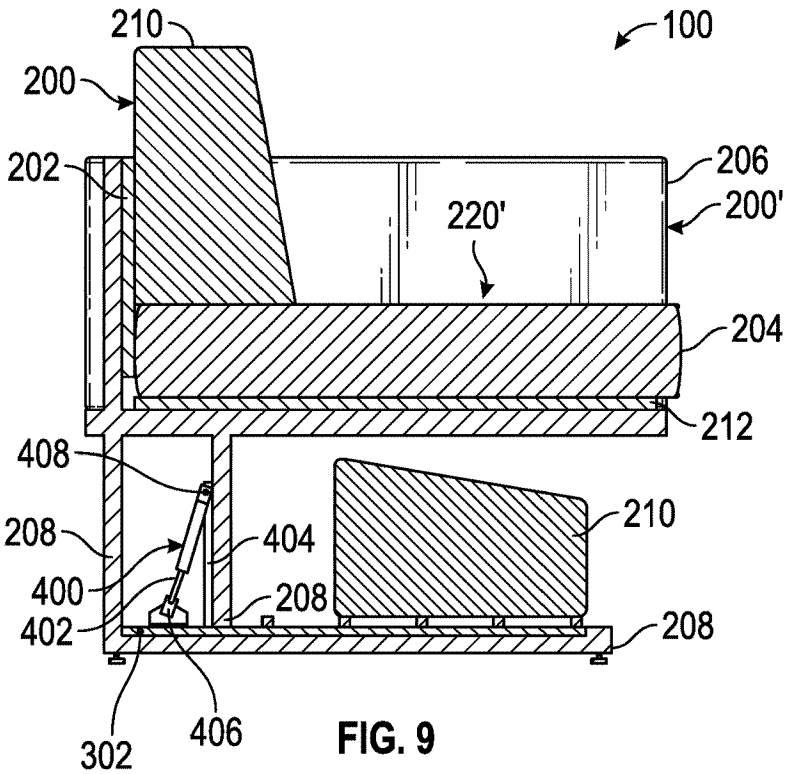
FIG. 9 is a side cross-sectional view of the seating apparatus shown in FIG. 5.
Figure 8:
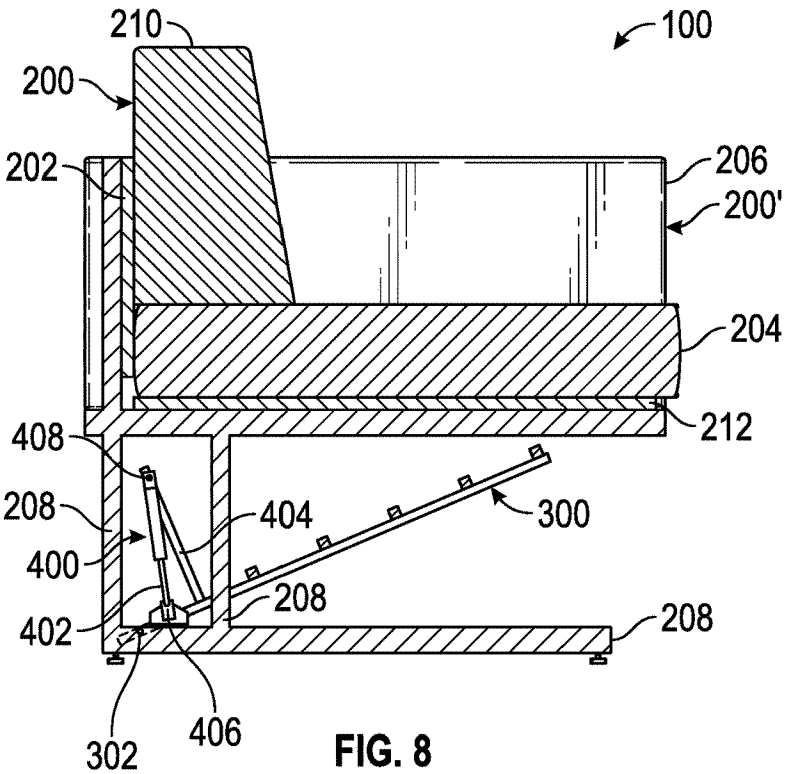
FIG. 8 is a side cross-sectional view of the seating apparatus shown in FIG. 2.

In particular embodiments, adjustable storage device (300) may be a flat platform or rack (300) pivotally connected to the leg structure (208) at a proximate end (302) of the leg structure (208) adjacent to the seat back (202). See, e.g., FIGS. 6 to 9 and FIG. 12. Storage device (300) includes a storage surface (300C) configured to allow for easy and secure storage of components of seating device (200). See, e.g., FIGS. 1 and 6. Particularly, storage surface (300C) of storage device (300) may allow for placement and storage of back support systems (210) such as at least one removable back cushion (210). See, e.g., FIGS. 5 and 9. As shown in FIGS. 1 and 2, storage rack (300) includes a first set of metal bars positioned adjacent to each other and perpendicular to bottom beam portions of cantilever legs (208), with the first set of metal bars mounted on a second set of metal bars. Each of the second set of metal bars may be positioned adjacent and parallel to each bottom beam portion of each cantilever leg (208). See FIGS. 1 and 7. An end of each of the second set of metal bars may be pivotally connected to the bottom beam portion of each cantilever leg (208) at a proximate end (302) of the bottom beam portion adjacent to the seat back (202). See, e.g., FIGS. 2 and 6. In exemplary embodiments, storage rack (300) includes a first set of five metal bars mounted on a second set of four metal bars pivotally connected at proximate end (302) of leg structure (208). See FIG. 1. Alternatively, storage device (300) may include other configurations having a storage surface (300C) for storage of components of seating device (200).

In exemplary embodiments, storage device (300) may be adjusted to at least one of two resting positions, a fully lowered position (300A) and fully raised position (300B), via at least one raising-lowering device (400) pivotally connected to leg structure (208) and storage device (300). See, e.g., FIGS. 1, 2, 7, and 8. Attachment of the raising-lowering device (400) to storage device (300) allows for easy adjustment of the storage device (300) from the lowered position (300A) to the raised position (300B) with minimum effort by a user. Embodiments of the present disclosure further provide for hands-free resting positions (300A, 300B) of storage device (300) without the use of latches or locks, or requiring a user to hold the storage device (300) or engage or activate supplementary systems. While in the lowered position (300A), storage device (300) may rest on the bottom beam portion of the cantilever leg (208), and while in the raised position (300B), storage device (300) may be restrained by the bottom of upper beam portion of leg (208) of seating device (200). See, e.g., FIGS. 7 and 8.

At least one raising-lowering device (400) may be attached to/integrated with storage device (300) to assist in supporting the weight of the storage device (300) in the raised position (300B) and allowing for smooth operation of the storage device (300) between the raised and lowered positions (300B, 300A). In exemplary embodiments, at least one raising-lowering device (400) may be a compression gas spring (402) or other type of conventional compression spring pivotally connected to a moment arm member/vertical framing member (404). See, e.g., FIGS. 6, 7, 8, 9, and 12. In various embodiments, compression rating of spring (402) may be designed for the exact cantilevered weight of storage device (300), the arcing motion of storage device (300), and the relative orientation and movement of the spring (402) with the storage device (300). The resulting compression spring (402) rating to be utilized is a designed and minor load deficiency so that the weight of the storage device (300) can overcome the compression of the spring (402) with light or minimal assistance from a user.

Each gas spring (402) may be pivotally connected to the leg structure (208) at a first end (406) and to the moment arm member (404) at a second end (408). See, e.g., FIG. 6. Moment arm member (404) may be fixedly connected to storage device (300) at an opposing end to the second end (408). See, e.g., FIGS. 6 and 8. As shown for example in FIGS. 6 to 9, moment arm member/vertical framing member (404) is located in a position forward of the connection at first end (406) and away from seat back (202) of seating device (200). This positioning of arm member (404) results in the spring (402) being oriented at a forward-of-vertical position, i.e., oriented slanting forward away from seat back (202) and at a less than ninety degree angle relative to the floor space away from seat back (202). See, e.g., FIG. 6. This positioning of the spring (402) allows for compression forces of the spring (402) to push the storage device (300) downward into the fully lowered position (300A).

Storage device (300) may be easily lifted to fully raised position (300B) in an arcing motion by applying a gentle force on storage device (300) to overcome the force differential between the compression rating of the spring (402) and the weight of the storage device (300). During this arcing motion, the moment arm/vertical framing member (404) may be rotated via pivoting connections at proximate end (302), first end (406) and second end (408). Once in the fully raised position (300B), spring (402) is oriented at a rear-of-vertical position, i.e., oriented slanting rearward towards seat back (202), and at a greater than ninety degree angle relative to the floor space away from seat back (202). See, e.g., FIG. 8. This rear-of-vertical position of spring (402) is designed such that compression forces of the spring (402) may assist in restraining the storage device (300) in the fully raised position (300B) without the need for any latches, locks, or manual assistance from user. Storage device (300) may also be easily lowered to fully lowered position (300A) by similarly applying a gentle force on storage device (300). Here, the same designed force differential between the compression rating of the spring (402) and the weight of the storage device (300) allows for the spring (402) to resist most of the weight of the storage device (300), thereby resulting in a slow and controlled lowering of the storage device (300).

Connections at proximate end (302), first end (406) and second end (408) may include any type of pinned/hinge/ pivoting connections allowing for at least one raising-lowering device (400) to adjust storage device (300) between the fully lowered position (300A) and fully raised position (300B) in a consistent arcing motion/movement, including for example, sealed live swivel pivot joints and other pivotable joints. Arcing motion of storage device (300) may be guided by a pivoting connection on proximate end (302) of the bottom beam portion of cantilever leg (208) adjacent to the seat back (202). For example, arcing motion of storage device (300) may be guided by a steel pin or similar connector that provides a pivoting point along the pin/connector's longitudinal axis. In this embodiment, the pin may be located symmetrically along the width of the storage device (300) so that lifting forces and loads are equal and balanced throughout the movement. Pins/connectors may be located at fixed locations within the structural framing of legs (208) so that a predictable and consistent arcing motion is achieved and so that the storage device (300) operates fluidly, with minimum resistance and without binding. Pins/connectors may be attached through various methods (e.g. welded, threaded bolt) to the primary structural frame of legs (208), but these attachments must also allow for the connection of the storage device (300) to be non-fixed so that the arcing motion can occur. In some embodiments, spacers may be utilized to provide adequate clearance between the structural framing of each leg (208) at the location of the pivoting connection at proximate end (302) and portion of the storage device (300) attached to leg (208) at proximate end (302), and to allow for fluid and minimal friction to occur between the storage device (300) and leg (208). In an exemplary embodiment, connection of gas spring (402) at first end (406) may be a knuckle joint connector allowing for a frictionless arcing movement.

Embodiments provide a method for converting a seating device (200) into a sleeping device (200'). Methods include using the seating apparatus (100) described herein, including seating device (200), sleeping device (200'), storage device (300), back support system (210), and raising-lowering device (400). In an exemplary embodiment, the method includes adjusting storage device (300) located beneath the seating device (200) from a fully raised position (300B) into a fully lowered position (300A) via at least one raising-lowering device (400), removing the back support system (210) and placing it within the storage device (300) to create the sleeping device (200'). Back support system (210) may be configured to fit within the storage device (300).

Embodiments of the present disclosure include convertible seating-to-sleeping furniture having a light-weight design that does not require a user to manipulate mechanisms or components that need to be further expanded, unfolded, or engaged while converting from a seating device to a sleeping device. Embodiments of the present disclosure require less material and surface area to be cleaned and disinfected prior to admission of new patients, thereby increasing cleaning time efficiencies and infection control benefits. Embodiments of the present disclosure also allow for easy cleaning of floor space underneath a seating device, without relocating the entire device to a different location in a room.

While the embodiments are described with reference to various implementations and exploitations, it will be understood that these embodiments are illustrative and that the scope of the inventions is not limited to them. Many variations, modifications, additions, and improvements are possible. Further still, any steps described herein may be carried out in any desired order, and any desired steps may be added or deleted.

What is claimed is:

1. An apparatus, comprising:

a convertible seating device; and an adjustable storage device located beneath, and pivotally connected to, the convertible seating device, wherein the adjustable storage device may be adjusted via at least one raising-lowering device including a first spring apparatus pivotally connected to the seating device at a first end and to a first moment arm member at a second end, wherein the first moment arm member is fixedly connected to the storage device at an opposing end to the second end, wherein the at least one raising-lowering device is configured to adjust the storage device in at least one of a fully raised and fully lowered position.

2. The apparatus of claim 1, further comprising an additional raising-lowering device including a second spring apparatus pivotally connected to the seating device at a first end and to a second moment arm member at a second end, wherein the second moment arm member is fixedly connected to the storage device at an opposing end to the second end.

3. The apparatus of claim 2, wherein the first and second spring apparatuses are gas springs.

4. An apparatus, comprising:

a convertible seating device; and an adjustable storage device located beneath the convertible seating device, wherein the adjustable storage device may be adjusted via at least one raising-lowering device pivotally connected to the seating device and storage device, wherein the convertible seating device includes a leg structure, a seat back and seat base integrated with or attached to the leg structure, a base cushion mounted on the seat base, and at least one arm mounted on the leg structure at an end of the base cushion, and wherein the leg structure includes four C-shaped cantilever legs configured to support the seating device, wherein each cantilever leg includes at least a bottom beam portion sitting on a floor, an upper beam portion mounted to at least one of the seat base and the base cushion, and at least one upright beam connected between the bottom and upper beam portions.

5. An apparatus, comprising:

a convertible seating device; and an adjustable storage device located beneath the convertible seating device, wherein the adjustable storage device may be adjusted via at least one raising-lowering device pivotally connected to the seating device and storage device, wherein the convertible seating device includes a leg structure, a seat back and seat base integrated with or attached to the leg structure, a base cushion mounted on the seat base, and at least one arm mounted on the leg structure at an end of the base cushion, wherein the adjustable storage device is a flat platform or rack pivotally connected to the leg structure at a proximate end of the leg structure adjacent to the seat back, wherein the at least one raising-lowering device is pivotally connected to the leg structure and storage device and configured to adjust the storage device in at least one of a fully raised and lowered position, and wherein the at least one raising-lowering device includes a first gas spring pivotally connected to a first moment arm member.

6. An apparatus, comprising:

a convertible seating device; and an adjustable storage device located beneath the convertible seating device, wherein the adjustable storage device may be adjusted via at least one raising-lowering device pivotally connected to the seating device and storage device, wherein the convertible seating device includes a leg structure, a seat back and seat base integrated with or attached to the leg structure, a base cushion mounted on the seat base, and at least one arm mounted on the leg structure at an end of the base cushion, wherein the adjustable storage device is a flat platform or rack pivotally connected to the leg structure at a proximate end of the leg structure adjacent to the seat back, wherein the at least one raising-lowering device is pivotally connected to the leg structure and storage device and configured to adjust the storage device in at least one of a fully raised and lowered position, wherein the at least one raising-lowering device includes a first gas spring pivotally connected to a first moment arm member, and a second gas spring, wherein each of the first and second gas springs is pivotally connected to the leg structure at a first end and to the first and a second moment arm member, respectively, at a second end, wherein each of the first and second moment arm members is fixedly connected to the storage device at an opposing end to the second end.

* * * * *